United States Patent [19]

Wenzel

[11] Patent Number: 4,597,561

[45] Date of Patent: Jul. 1, 1986

[54] LIFTING AND DEPOSITING DEVICE FOR PORTABLE CONTAINERS, E.G., CONTAINERS, SHELTERS, SUPERSTRUCTURE REPLACEMENTS PARTS OR THE LIKE

[75] Inventor: Jorg Wenzel, Freudenberg, Fed. Rep. of Germany

[73] Assignee: Haacon Hebetechnik GmbH, Freudenberg, Fed. Rep. of Germany

[21] Appl. No.: 510,189

[22] Filed: Jul. 1, 1983

[30] Foreign Application Priority Data

Jul. 3, 1982 [DE] Fed. Rep. of Germany ..... 3224890

[51] Int. Cl.[4] ..... B66F 7/26

[52] U.S. Cl. ..... 254/45; 74/89.15; 74/535; 254/97

[58] Field of Search ..... 254/45, 2 B, 95, 97, 254/427; 187/8.47, 8.49, 8.5; 74/89.15, 535

[56] References Cited

U.S. PATENT DOCUMENTS 1,161,610 11/1915 Burkholder ..... 254/95

1,853,155 4/1932 Van Dyken ..... 254/95

FOREIGN PATENT DOCUMENTS 1586723 10/1977 Fed. Rep. of Germany .

*Primary Examiner*—Frederick R. Schmidt

*Assistant Examiner*—Judy J. Hartman

*Attorney, Agent, or Firm*—Quaintance, Murphy & Presta

[57] ABSTRACT

A lifting and depositing device for portable containers comprising a plurality of rack and pinion jacks, some of which are mounted on support legs of the container. Each rack and pinion jack has an accessory gearing which can be pivoted outwardly or removed, so that when accessory gearing is pivoted outwardly, a support leg can be manually moved axially relative to its guide part, if the container, e.g., is offset on the loading surface of a truck. Thus, the gearing operation and time-consuming crank work required until now for two idle strokes per work cycle is avoided.

11 Claims, 18 Drawing Figures

10
13
15
56
11
14

16
18
27
37
36
35
34
32
29
17
22
12

22
28
32
35
34
22
29
17

Fig. 8
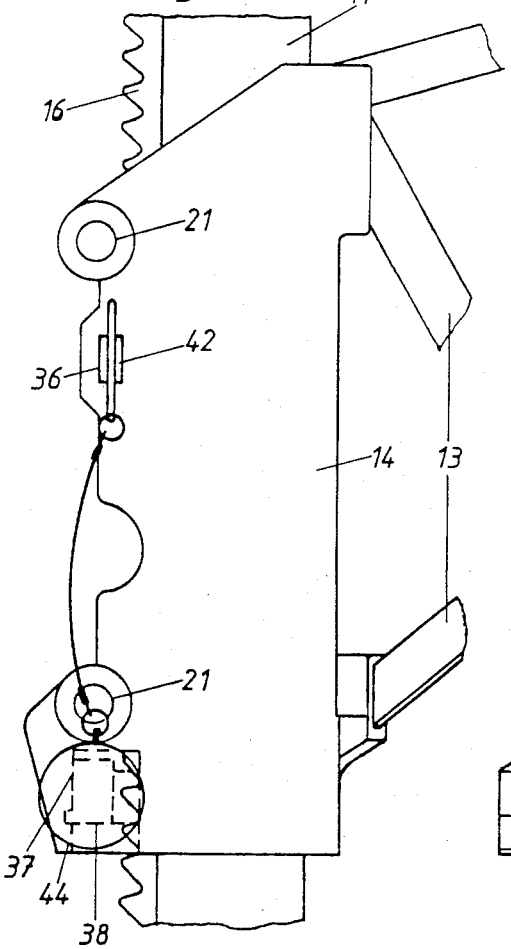
Fig. 9
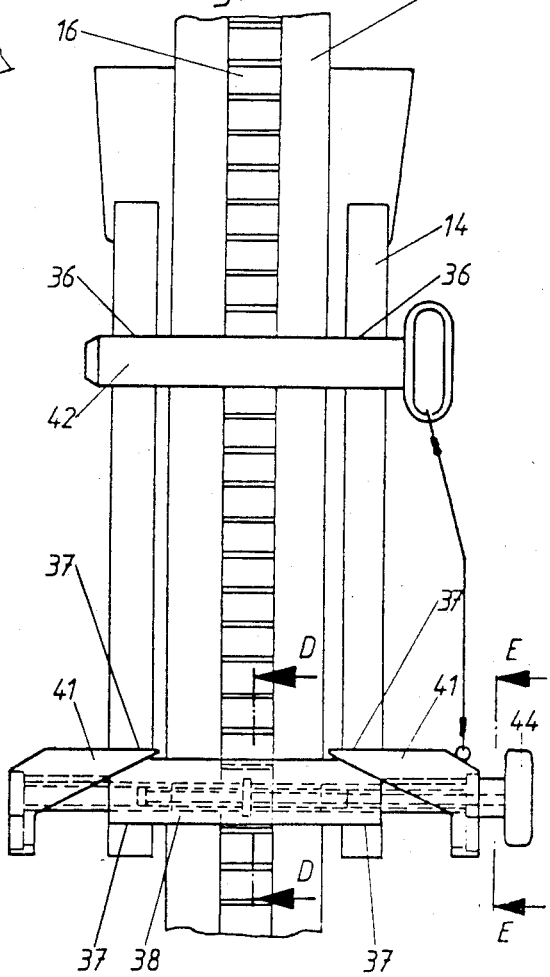
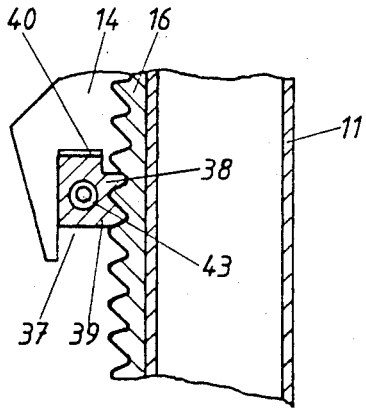
Fig. 10
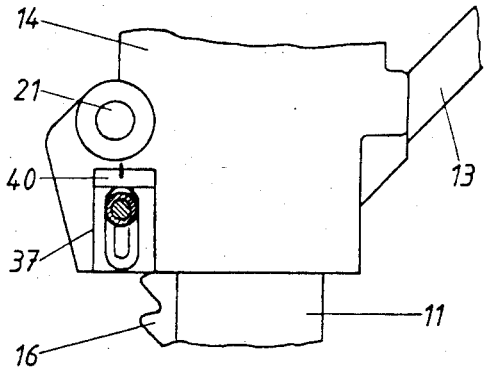
Fig. 11

LIFTING AND DEPOSITING DEVICE FOR PORTABLE CONTAINERS, E.G., CONTAINERS, SHELTERS, SUPERSTRUCTURE REPLACEMENTS PARTS OR THE LIKE

BACKGROUND OF THE INVENTION

The invention relates to a lifting and depositing device for portable containers, e.g., containers, shelters, superstructure replacement parts or the like, with a plurality of rack and pinion jacks to be fastened on the container, of which the jack housings can be connected with the container, and can be raised and lowered along a support leg with a rack, and the jacks have parts which can be pivoted away or removed.

A lifting and depositing device of this type is already disclosed in German Pat. No. 1,586,723. With this device, the jack housings can be opened to the outside by the parts which can be pivoted to the side or removed, so that the support legs can be inserted from the outside transversely to the lift direction into the open jack housing, which provides the advantage that the support legs can be connected at practically any height on the container with the rack and pinion jacks on the side of the container. Thus, time-consuming cranking which is otherwise necessary for the two idle strokes during a work cycle (depositing the container from the vehicle onto the ground and later the reverse) is unnecessary.

It is known that the separate rack and pinion jacks are moved together when not in use, saving space during storage. Because of the possibilof separation of the support legs from the rack and pinion jacks, detachably attached to the portable containers, this lifting and depositing device is divided into individual lightweight parts which are easy to handle. However, here the rack and pinion gear, forming one part with the bracket, is still relatively heavy and therefore correspondingly difficult to handle. Also, with the jack housing parts pivoted away, the support legs could not be manually moved axially into the jack housing, in order to optionally by-pass the required idle stroke. For this purpose, the support legs must always be moved to the side out of the opened jack housings.

A lifting and depositing device for portable containers is also disclosed in German Pat. No. 2,540,400, in which the bracket can be separated from the rack and pinion jacks and their housings. Here, however, the rack and pinion jack gearing with relatively high jack housings are again in one part and form a correspondingly heavy structural part. One further drawback of this known device resides in the fact that, because of the closed jack housing, the idle stroke must both upwards and downward be by-passed continuously by means of the rack and pinion gearing by means of time-consuming cranking.

SUMMARY OF THE INVENTION

The object of the invention is a lifting and depositing device for portable containers, in which the time-consuming idle stroke over the jack gearing can be avoided by manual movement of the support legs in the jack housings, and at the same time more weight is saved because of the separate parts of the lifting and depositing device, which facilitates handling. Furthermore, if needed, the gearing or at least the driving pinion of the rack and pinion jack and the racks in the jack area can be cleaned.

This is attained according to the invention in that the part of each jack housing which can be pivoted to the side or can be removed is configured as an accessory gearing.

When the accessory gearing is removed, the weight of the individual parts of each rack and pinion jack is further reduced, so that they are simpler to handle. If the accessory gearing is pivoted to the side or away, further required cleaning of the gearing could be carried out simply. This is not possible with the lifting and depositing device of German Pat. No. 1,586,723, since here the jack gears are arranged on the bracket between the container and the individual racks and support legs, and the racks on the support legs are turned toward the container. The same is also true for the lifting and depositing device of German Pat. No. 2,540,400, in which the jack gearing housings are connected with the guide parts of the jack housings for the support legs.

The invention furthermore makes it possible that with accessory gears pivoted to the side, the idle stroke as by-passed by operation of the jack gearing is unnecessary, and the support legs need only be moved up or down with their rack and pinions in their jack housings. Upon disassembly of the lifting and depositing device, the support legs with their racks can be drawn completely out of the jack housing.

The present invention provides the advantage that with the friction brake device, when the accessory gearing is pivoted out or removed, the support leg and rack can be secured in the guide part of the jack housing against undesired slippage. The additional security against withdrawal combined with the friction brake device prevents any subsequent undesired tearing of the support leg from the jack housing.

In accordance with another refinement of the invention, even when the accessory gearing is pivoted out or removed, with the outwardly opened jack housing, the racks (with the support leg) can be fixed on the guide part of the jack housing. This advantage then appears as very important when the lifting and depositing device is very dirty and carries a more or less heavy container, so that poor operation or total blocking of the rack and pinion jack for manipulation of the container is to be feared. In this case, one need only exchange or remove the accessory gearing, so that at least the driving pinion and the area of the racks of the gearing can be easily cleaned. This work can take place while the lifting and depositing device is loaded, because if the gearing is pivoted out or removed, the relevant rack is fixed on the jack housing by the stop device. The associated lifting device advantageously allows release or separation of the gearing from the relevant loaded rack. This embodiment of the invention also provides more advantageously than when the containers are mounted and braced on the lifting and depositing device, the accessory gearing can be removed and can be stored at a safe site, which secures it against misuse, so that it will last longer. However, it is also possible to use the removed accessory gearing with other containers to be lifted or deposited, which means that a series of gearings can be used for the operation of a plurality of lifting and depositing devices one after the other.

The invention provides the advantage that it is simpler to produce a satisfactory operative connection between any one accessory gearing and a rack. The guide part, which slips along on the support leg, also forms a guide for the housing of the attached accessory gearing.

When the guide part of the jack housing also forms a part which is connected detachably with a bracket to be mounted on the container, the weights of the individual parts of the lifting and depositing device are reduced and they are thus made still easier to handle.

When the accessory gearing is connected detachably by cotter bolts on its top and bottom ends with the guide part of the jack housing, only the part connected by one cotter pin can advantageously be pivoted out upwardly or downwardly around the other cotter pin for cleaning.

A further embodiment of the invention shows that the guide parts of the jack housing cannot buckle if the support legs are at an obtuse angle.

Also, when the accessory gearing with at least one gearwheel overlaps the side of the guide part of the jack housing, a relatively large reduction ratio can be produced advantageously with relatively smoothly constructed gearing.

In accordance with another simple embodiment of the lifting and stopping device, the wedge-shaped parts can be moved toward or away from each other by a spindle which is axially immovable in the stop element but which can be manually rotated, with right and left threading on the ends which engage in corresponding threads in the wedge-shaped parts.

In the use of the present invention, the stop element can be relatively small, which means a saving of weight, and the safety shaft prevents the support leg from breaking out from the guide part of the jack housing (around the stop element) when it has stopped.

BRIEF DESCRIPTION OF THE DRAWINGS

The invention will be further clarified relative to the drawings of exemplary embodiments. They show:

FIG. 8 is a side elevational view of the guide part of the jack housing with a part of a support leg with a rack, the stop element and the safety shaft being in an operational state;

FIG. 9 is a front elevational view of the device of FIG. 8;

FIGS. 10 and 11 are partial cross-sectional views taken substantially along the lines D—D and E—E, respectively of FIG. 9;

DESCRIPTION OF THE PREFERRED EMBODIMENTS

Figure 2:
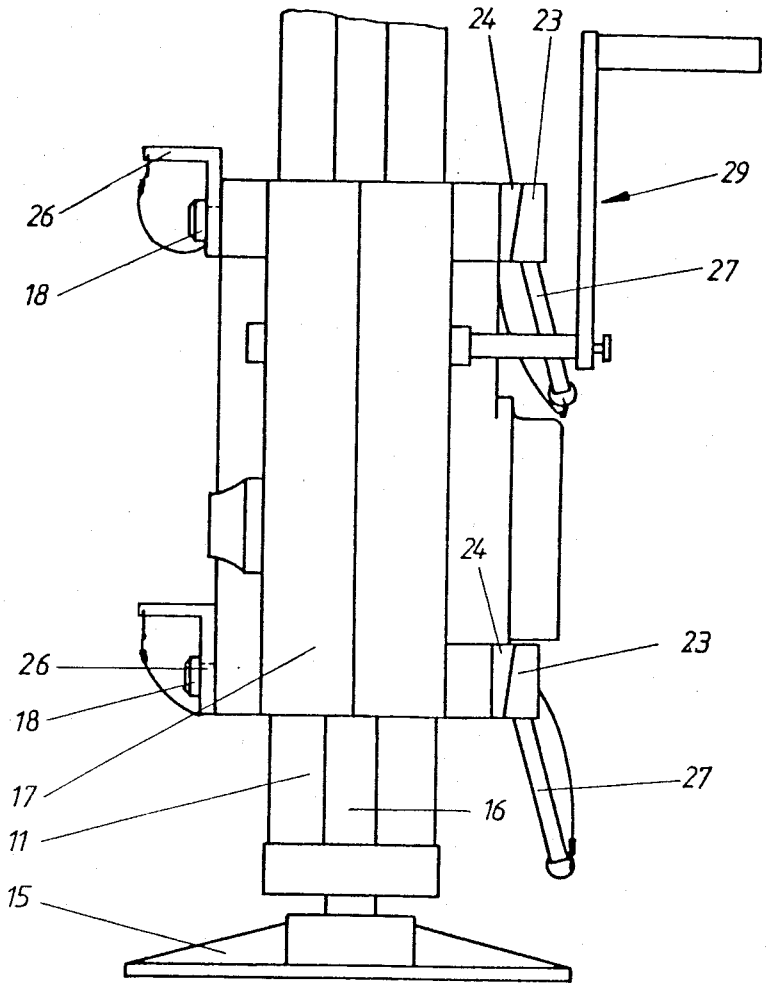
FIG. 2 is a front elevational view of the device of FIG. 1.

The embodiments of the invention corresponding to FIGS. 1–13 and 14–18 represent lifting and depositing devices intended for containers of generally rectangular shape. Both exemplary embodiments have four support legs 11 with associated rack and pinion jacks 12 and 12', which can be detachably mounted on brackets 13 and 13' on the side of a container, e.g., 10, or on its corner. A container can be lifted by means of this lifting and depositing device, and can be deposited on the loading surface of a truck, or vice versa can be lifted from this loading surface and, with the device in lifted state, can be transported and can even be deposited on the ground or on a special carrying platform. A rack and pinion jack 12 with connected support leg 11 is described in the following. All rack and pinion jacks 12 and support legs 11 are identical.

The rack and pinion jack 12 has a guide part 14 supported on an essentially U-shaped support leg 11. Support leg 11 can be a quadrangular tube. A footplate 15 is at the bottom end of support leg 11. Guide part 14 in the embodiment is connected inflexibly with bracket 13, but these parts can also be detachably connected. Bracket 13, as aforementioned, can be mounted detachably on the side wall of container 10 near the corner. A rack 16 is preferably found in the middle of the outside of support leg 11.

Figure 4:
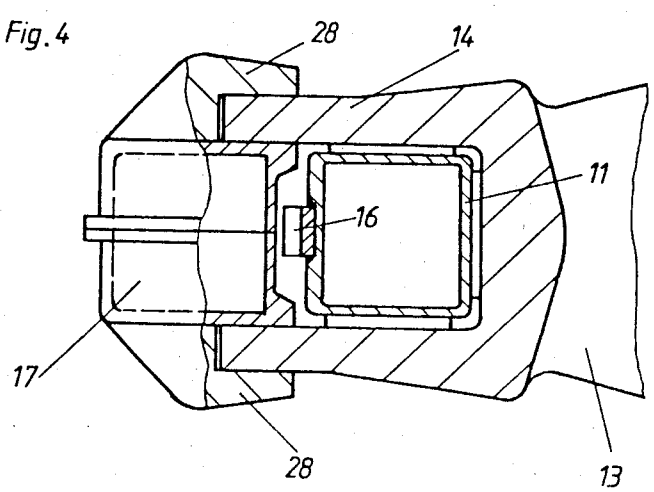
FIGS. 3, 4 and 5 are transverse cross-sectional views taken substantially along lines A—A, B—B and C—C, respectively, of FIG. 1.
Figure 3:
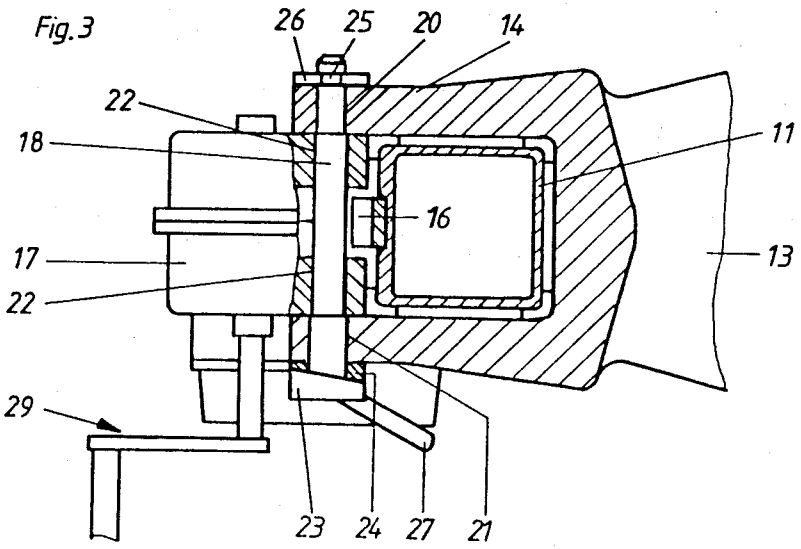
Figure 5:
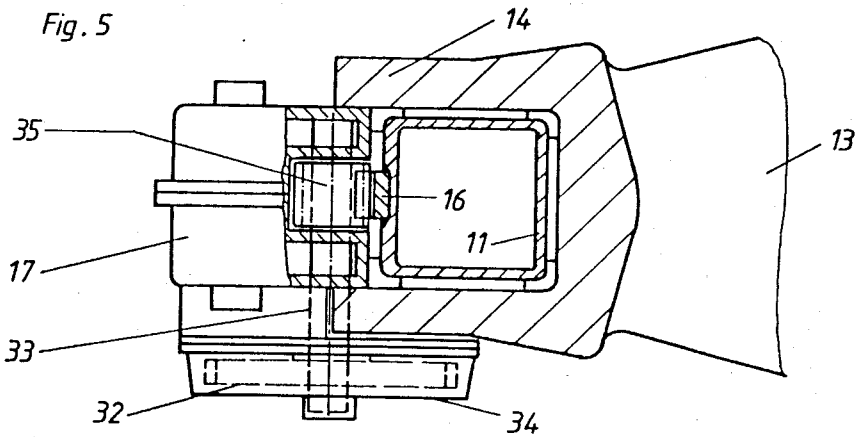

Rack and pinion jack 12 also has an accessory gearing 17 which is arranged on guide part 14 so that it can be pivoted outward or removed. The housing of accessory gearing 17 is encased separately, and in the attached state it extends fitting partially into U-shaped guide part 14, as shown in FIGS. 3 to 5. In the embodiment, accessory gearing 17 is connected detachably with guide part 14 by identical cotter pins 18 which, fitting through corresponding bores 20, 21, extend into guide part 14 or 22 in the housing of gearing 17. On the bottom end, cotter pins 18 have a part 23 with an inward directed screw thread, which cooperates with an outward directed screw thread on parts 24, which are found on the outside of guide part 14. Cotter pins 18 extend through middle bores in parts 24. The opposite ends of cotter pins 18 are provided with grooves 25 to receive safety flanges 26 which have corresponding slots. When safety flanges 26 are inserted, with suitable rotation of cotter pins 18 by means of the lever 27 based on the cooperation of the screw threads on parts 23 and 24, the housing of accessory gearing 17 can be braced in guide part 14. In this state, cotter pins 18 also secure guide part 14 against "spreading" as a result of support leg 11, when pivot forces engage on it, which can occur when the ground is not level. An additional or alternative security can be formed as shown in the embodiment of two holding strips 28 mounted at the same level on the housing of accessory gearing 17 (FIGS. 1 and 4), which, when gearing 17 is attached, overlap guide part 14 at the side.

Figure 1:
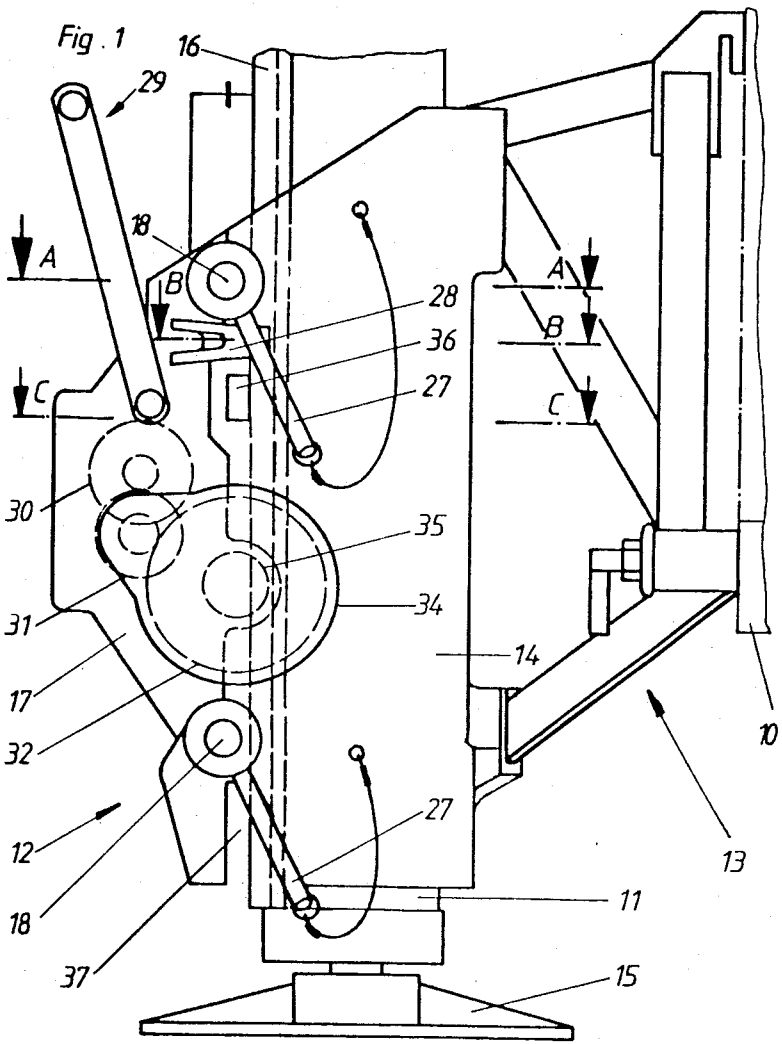
FIG. 1 is a side elevational view of a rack and pinion jack on a container, the jack working on a support leg of the lifting and depositing device, wherein only one part of the support leg and the container is shown.

The crank handle of gearing 17 is 29 and some of the gearwheels of the accessory gearing in FIG. 1 are 30, 31, and 32. With the desired reduction ratio, in order to attain a relatively smooth accessory gearing 17, gearwheel 32 with the largest diameter is arranged in a housing part 34, which overlaps guide part 14 at the side. Gearwheel 32 sits nonrotatably on a shaft 33 (FIG. 5), on which the driving pinion 35 for rack 16 on support leg 11 is also mounted.

Figure 7:
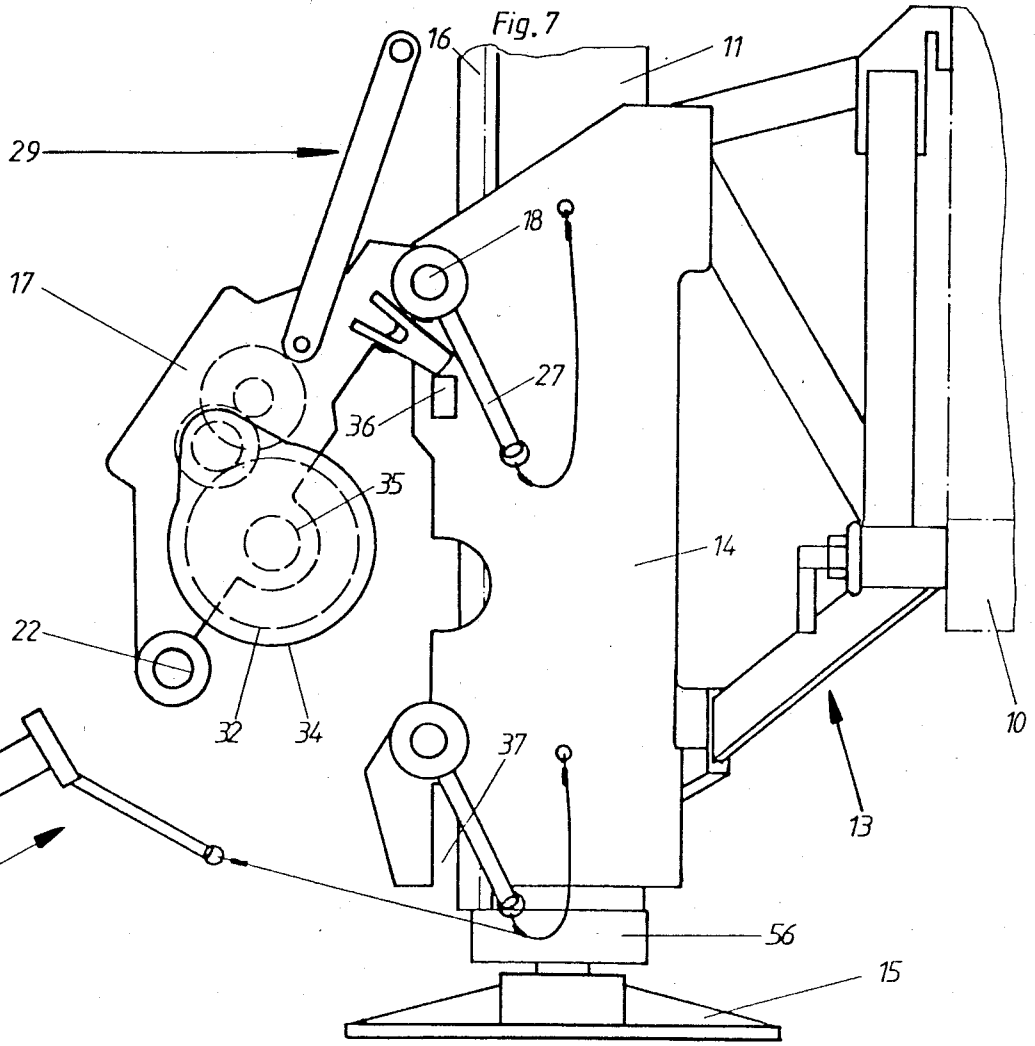
FIG. 7 is a side elevational view similar to FIG. 1, showing the accessory gearing pivoted outwardly.
Figure 6:
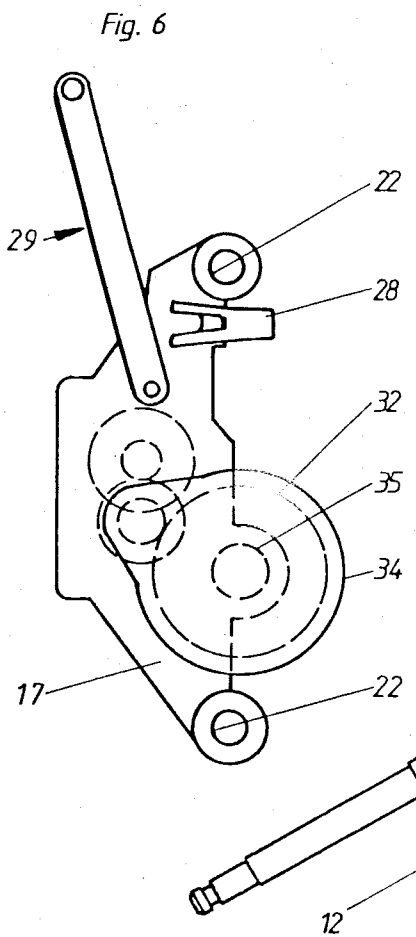
FIG. 6 is a side elevational view of the accessory gearing of a rack and pinion jack corresponding to FIG. 1.
Figure 13:
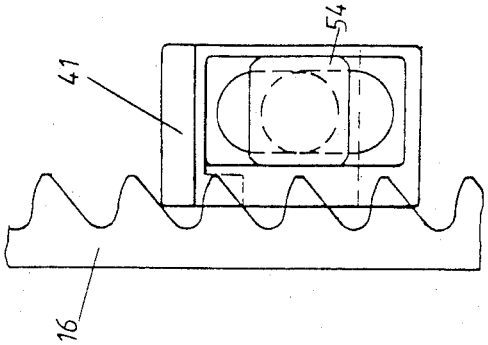
FIG. 13 is a side elevational view of the device of FIG. 12.
Figure 12:
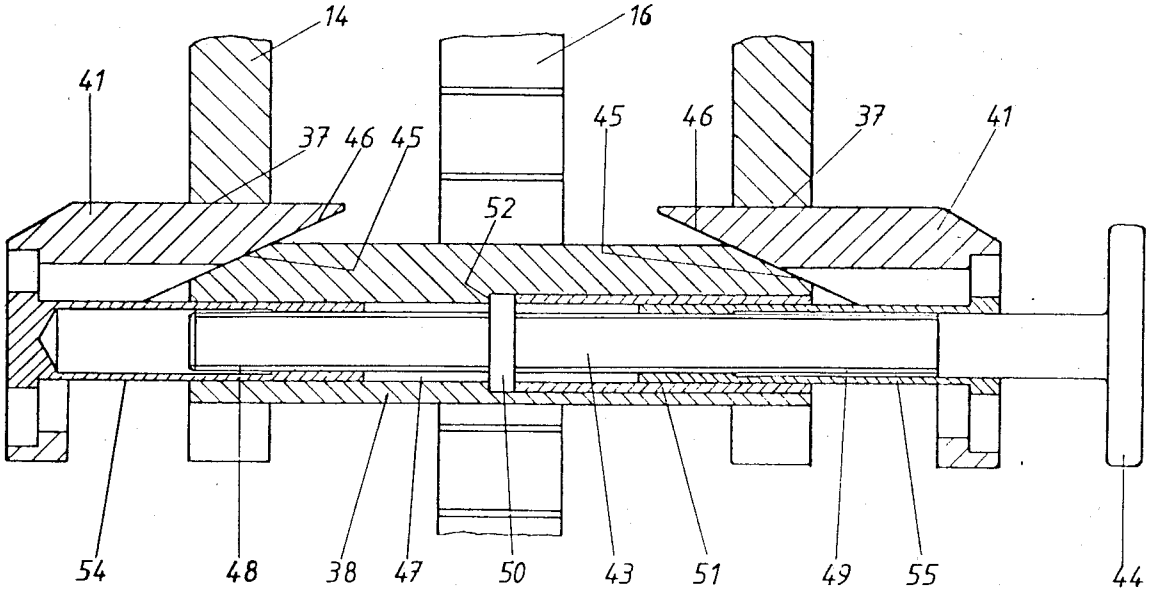
FIG. 12 is an enlarged view, partly in cross section, of the bottom portion of the device of FIG. 9.

In dusty areas, when container 10 is carried for a long time raised up from support legs 11, driving pinion 35 and racks 16 can get dirty, which can slow the operation or even block the rack and pinion jacks 12. In case of this, so as to be able to clean driving pinion 35 as well as racks 16 for the operation of rack and pinion jacks 12, also relative to the accessory gearing 17, accessory gears 17 are either removed by guide parts 14 or can be pivoted out, as shown in FIG. 7. For this, safety flanges 26 are first removed, so that the cotter pins 18 of FIG. 2 can be drawn out to the right. Thereupon the accessory gearing 17 can only be cleaned when accessory gearing 17 is pivoted out of the way, for example only the bottom cotter pin 18 is removed, so that gearing 17 can be pivoted upward around top cotter pin 18 (FIG. 7). A lifting and depositing device is to be found between each guide part 14 and support leg 11 or its rack 16, in order to facilitate removal of accessory gearing 17 from guide parts 14 or their pivoting out under a load (i.e., with raised container 10), which is to be explained hereinafter with reference to FIGS. 8 to 13.

Guide part 14 of the jack housing is U-shaped and both arms are provided near the front with countersunk openings 36 and 37 on the sides. These are open downward. A stop element 38 fits in side openings 37 for the withdrawal of one or both cotter pins 18, and stop element 38 is provided with teeth 39 (FIG. 10), and brought into contact with rack 16. When stop element 38 is positioned in this manner in openings 37, wedge-shaped parts 41 are driven from the outside inward into the remaining intermediate spaces 40 between the top edge of stop element 38 and openings 37, and parts 41 cause an insignificant lift of guide part 14 in relation to support leg 11, and the friction between driving pinion 35 and the (loaded) rack 16 is reduced so that, after removal of one or both cotter pins 18 from guide part 14, accessory gear 17 can be removed or pivoted out. However, a safety shaft 42 is still inserted through openings 36, and when accessory gearing 17 is removed, it prevents support leg 11 from buckling forward out of guide part 14. For this purpose, safety shaft 42 stands in position with rack 16. It is to be noted that the rack and pinion jacks 12 are of a known embodiment under self-limiting load.

The oblique surfaces 46 of wedge-shaped parts 41 cooperate with corresponding oblique surfaces 45 on stop element 38. A spindle 43 is axially tightly mounted in a longitudinal bore 47 in stop element 38, but is rotatable, and the ends are each provided with a left or right threading 48, 49. An annular collar 50 is provided thereon for axial fixation of spindle 43, which is held by a bushing 51 pressed into the flared part of longitudinal bore 47, against a stop 52 in longitudinal bore 47. The left or right threading 48, 49 of spindle 43 engages with corresponding inner threading on sheathed operating parts 54, 55 for wedge-shaped parts 41. The sheathed operating parts 54, 55 for this purpose are axially movable in longitudinal bore 47 or in bushing 51, and are height adjustable in connection with wedge-shaped parts 41. With suitable manual rotation of spindle 43 by means of its knob 44, wedge-shaped parts 41 are forced against each other, by means of operating parts 54, 55 and they wander upward because of their cooperating oblique surfaces 45, 46, and by-pass intermediate spaces 40 and finally lift guide part 14 slightly in relation to rack 16 and support leg 11, so that the aforementioned friction closure between driving pinion 35 and rack 16 is lifted. Wedge-shaped parts 41 can again be held fast, as a result of opposite rotation of threaded spindle 43, so that, according to the structure of accessory gearing 17, stop element 38 can be removed again.

In FIG. 7 is to be noted that guide part 14 is shown in its bottom setting, in which it rests on a collar 56 on support leg 11, and stop element 38 is not required here when accessory gearing 17 is pivoted out.

In the embodiment of FIGS. 14–18, the rack and pinion jack 12' has a lifting and lowering, round, closed guide part 14' on support leg 11, which is relatively longer (approximately the height of the container), which is detachably mounted on bracket 13' on the side of the container (not shown) or on its corner. Support leg 11 with rack 16 corresponds essentially to that of the first embodiment. Tubular guide part 14' is closed off at the top by a cover 60, which can be removed for cleaning. Furthermore, guide part 14' has two top and two bottom strips 61 and 62 on the outside which are at some distance from the side, with bores 63 countersunk in the sides, as well as a cutout 64 which frees a section of rack 16.

Figure 14:
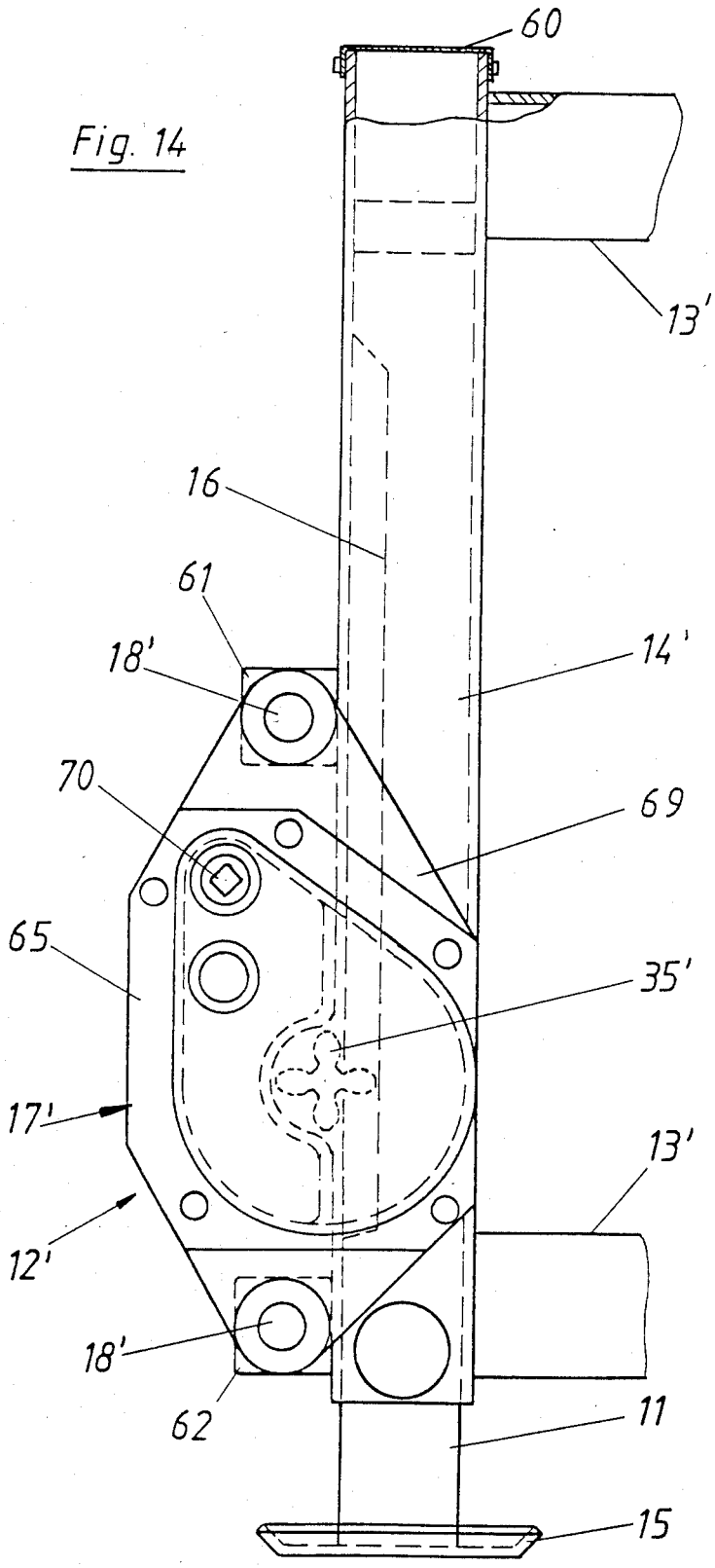
FIG. 14 is a side elevational view of a second embodiment of the invention with the jack housing having its side closed, and one attached accessory gearing.
Figure 16:
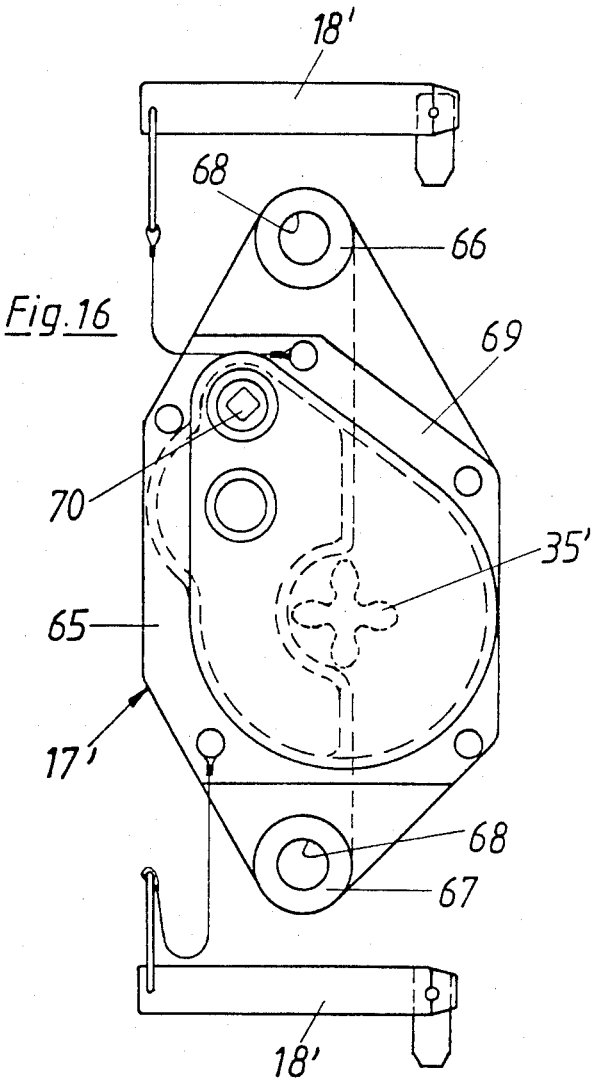
FIG. 16 is a side elevational view of the accessory gearing of the rack and pinion jack corresponding to that of FIG. 14.
Figure 15:
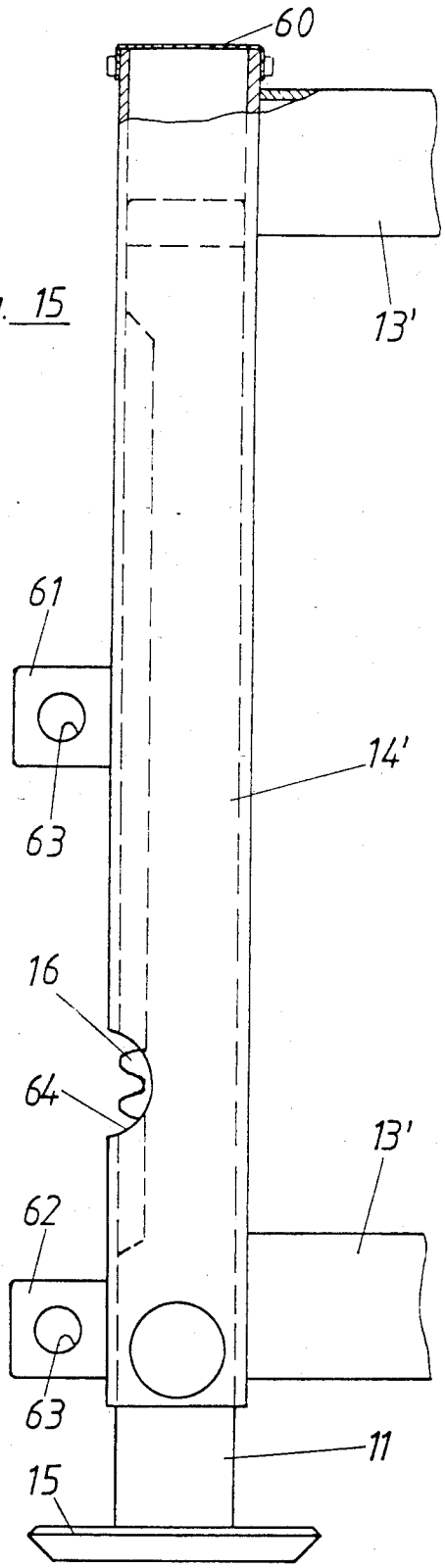
FIG. 15 is a side elevational view of the guide part of the jack housing for the support leg with rack corresponding to the device of FIG. 14.

Accessory gearing 17' in this embodiment has a housing 65 with top and bottom protrusions 66 and 67, with bores 68. The protrusions 66 and 67 fit exactly between the pairs of strips 61 and 62. When consequently accessory gearing 17' is to be connected with guide part 14', protrusions 66 and 67 need only be inserted between pairs of strips 61, 62 and bores 63, 68 countersunk side by side, so that cotter bolts 18' can fit through these bores. Housing 65 of accessory gearing 17' thus houses the U-shaped section 69 around guide part 14' and driving pinion 35' of gearing 17' comes into contact with rack 16. In FIGS. 14 and 16, 70 is the square drive shaft of accessory gearing 17', on which a handle (not shown) can be mounted for shifting gears. If only top cotter pin 18' connects accessory gearing 17' with guide part 14', gearing 17' can be pivoted away in clockwise direction as in FIG. 14, so that driving pinion 35' is separated from rack 16. To avoid an idle stroke during shifting of gears in this state or even with completely removed gearing 17', it is simply possible to move support leg 11' upward or downward in guide part 14' when the container is being deposited with the rack and pinion jack, e.g., on the loading surface of a truck. As in the first embodiment, it is advantageously possible to clean it when gearing 17' is pivoted out or removed.

Figure 17:
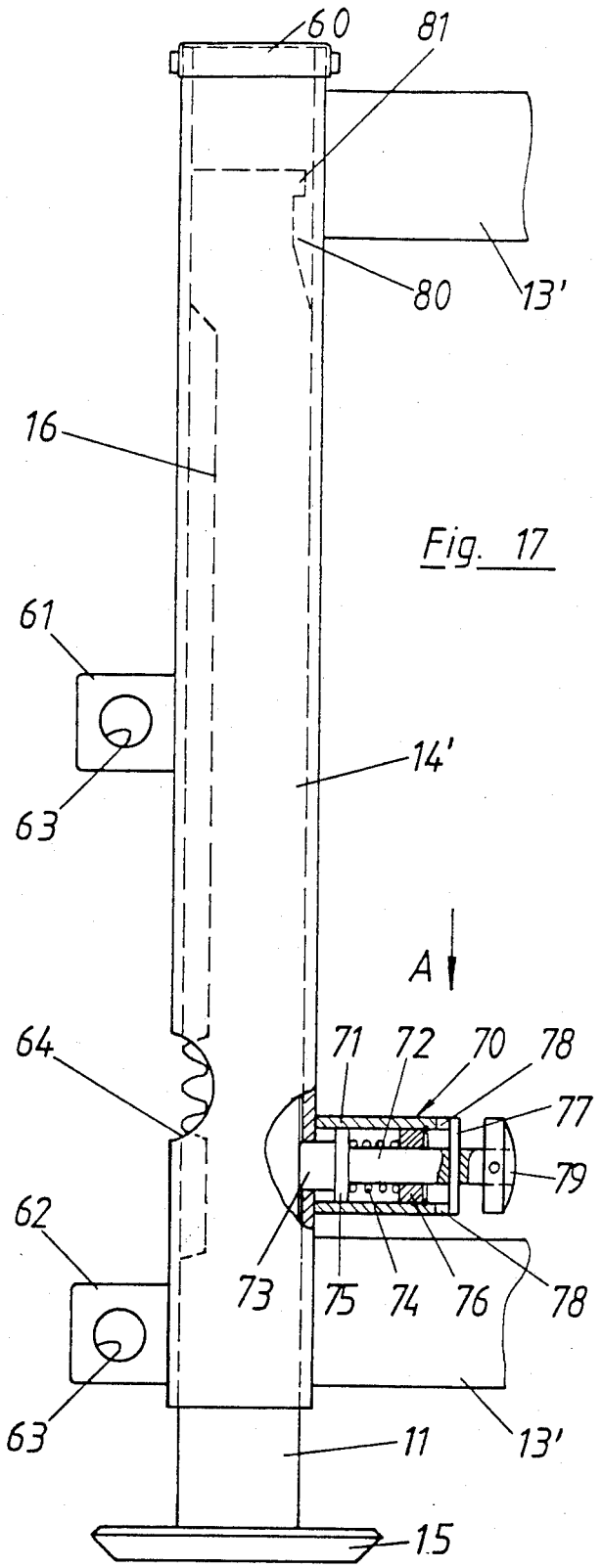
FIG. 17 is a side elevational view similar to that of FIG. 15, with a friction brake device, combined with an extraction safety for the support leg.
Figure 18:
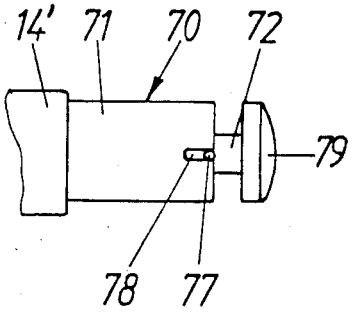
FIG. 18 is a partial plan view of a portion of the device of FIG. 17, taken in the direction of the arrow A.

Upon detachment of driving pinion 35' from rack 16, to avoid an undesired relative movement between support leg 11 and guide part 14' as a result of the force of gravity, a friction brake device 70 which cooperates with support leg 11 can be provided on guide part 14' (FIGS. 17, 18). This device 70 has a sheathing 71 mounted axially movably on guide part 14', but a bolt 72 is mounted nonrotatably, which engages on a friction body 73 at one end, which is pressed by a spring 74 against support leg 11 to prevent movement between parts 11 and 14'. Spring 74 is stretched for this purpose between an annular collar 75 on bolt 72 and a perforated disk 76 mounted inside on sheathing 71. A pin 77 extends through bolt 72, guided in sheathing 71 in slots 78 which are open to the outside. When brake device 70 is in operational state, which is shown in FIGS. 17 and 18, pin 77 is in contact with slot 78. If the friction brake device 70 should be inoperative, bolts 72 need to be drawn out by means of knob 79 against the pressure of spring 74, in order to bring pin 77 into position with the outside free edge of sheathing 71.

In the embodiment of FIG. 17, a cutout 80 is provided with a detent 81 on its top end, at the top of support leg 11, and friction brake device 70 also prevents extraction. Detent 81 remains suspended on friction body 73 on bolt 72, telescoped by spring pressure, when support leg 11 slips downward in guide part 14'. The friction brake device can also be in the hollow support leg and can cooperate with one or two friction bodies with the inside wall of guide part 14' (not shown).

What I claim is:

1. Lifting and depositing device for a portable container, the device having a plurality of rack and pinion jacks, each of which comprises a jack housing adapted to be connected with the container, a support leg with a longitudinally extending rack, the jack housing being mounted for substantially vertical movement on the support leg, and accessory gearing mounted on the jack housing for engagement with the rack, characterized in that means are provided to movably mount the accessory gearing on the jack housing so that it can be moved between a first position in engagement with the rack and a second position wherein it is out of engagement with the rack, whereby the accessory gearing and rack can be conveniently cleaned when the accessory gearing is in said second position, the jack housing comprising a guide part surrounding the support leg, and a lifting and stop device is mounted on the guide part and has stop means engagable with the rack to lift the guide part slightly to reduce friction between the accessory gearing and the rack to facilitate movement of the accessory gearing away from the rack, the lifting and stop device having means to releasably lock the stop means to thus releasably lock the rack to the guide part of the jack housing when the accessory gearing is in said second position.

2. Device as in claim 1, characterized in that a friction brake (70) is provided between a guide part and the support leg with rack and when accessory gearing is pivoted out or removed, the support leg with rack in the guide part of the jack housing prevents sideslipping, and a withdrawal safety for the support leg with rack.

3. Device as in claim 1, characterized in that the accessory gearing (17) comprises a housing and the jack housing comprises a guide part (14), the guide part being of U-shaped configuration and having a portion partially surrounding the gearing housing, the gearing housing being removably connected to said surrounding portion of the guide part.

4. Device as in claim 3, characterized in that the accessory gearing housing and guide part (14) of the jack housing are provided with aligned apertures (20,21,22) therein, and cotter pins (18) are removably mounted in the apertures (20,21,22) to detachably connect the accessory gearing housing to the guide part (14).

5. Device as in claim 3, characterized in that holding strips (28) are mounted on the housing of accessory gearing (17), said holding strips having portions which extend over and engage with guide part (14) of the jack housing.

6. Device as in claim 3, characterized in that the guide part (14) has a side portion, and the accessory gearing (17) comprises at least one gearwheel (32) having a portion disposed adjacent to the side portion of the guide part (14).

7. Device as in claim 1, characterized in that the lifting and stop device includes a stop element (38) with teeth (39) which can be brought into engagement with the rack (16) on support leg (11), movable wedge-shaped parts (41) in engagement with the stop element and the guide part, and means for moving the wedge-shaped parts in order to produce a relative movement between rack (16) and guide part (14).

8. Device as in claim 7 characterized in that stop element (38) is mounted near a bottom end of guide part (14), the guide part (14) has openings (36) in a top end thereof, and safety shafts (42) for support leg (11) are insertable in openings (36).

9. Device as in claim 1 wherein the accessory gearing is pivotally mounted on the jack housing.

10. Device as in claim 1 wherein the accessory gearing is removably mounted on the jack housing.

11. Device as in claim 3 characterized in that a bracket (13) is removably connected to the guide part (14) of the jack housing, the bracket (13) being adapted to be mounted on container (10).

* * * * *